United States Patent [19]

Hagan

[11] 3,938,068

[45] Feb. 10, 1976

[54] ELECTRICAL PLUG AND OUTLET UNIT

[76] Inventor: Charles Hagan, 226 Lynn Road, Ridley Park, Pa. 19078

[22] Filed: Apr. 2, 1975

[21] Appl. No.: 564,312

[52] U.S. Cl. ..... 337/189; 337/187; 339/153

[51] Int. Cl.[2] ..... H01H 85/46; H01H 85/48

[58] Field of Search ..... 337/189, 188, 187; 317/114, 116; 307/15; 339/153, 154, 155

[56] References Cited

UNITED STATES PATENTS

| | | | |
|---|---|---|---|
| 2,508,770 | 5/1950 | Oshinsky | 337/189 |
| 3,163,728 | 12/1964 | Martin | 337/189 |
| 3,349,363 | 10/1967 | Goodman | 339/155 |

*Primary Examiner*—Harold Broome

*Attorney, Agent, or Firm*—Anthony J. McNulty, Esq.

[57] ABSTRACT

An electrical plug and outlet unit adapted for insertion into a conventional three-socket, high voltage receptacle for providing a reduced voltage at at least one outlet forming a part of the unit. The unit includes a single conductor prong and a single ground prong projecting rearwardly from within a non-conductive body member. These prongs are arranged in a pattern for permitting the conductor prong to be received within one of the hot sockets of the high voltage receptacle, and for permitting the ground prong to be received within an equipment ground socket of the high voltage receptacle. Each of the unit outlets includes a pair of electrical contacts aligned with respective openings in a front face of the non-conductive body member for receiving prongs of a conventional low voltage plug. Electrically conductive means connects the conductor prong to one of the pair of electrical contacts of each outlet, and connects the ground prong to the other electrical contact of each outlet. In this manner one of the hot lines of the high voltage receptacle is omitted from the circuitry of the unit of this invention. Therefore, each of the outlets is of a reduced voltage, equal to one-half of the voltage of the receptacle into which the unit of this invention is plugged. Preferably, a fuse is in the conductive path that connects the conductor prong to its respective electrical contacts so that the current flowing through the electrical plug and outlet unit must traverse the fuse.

8 Claims, 5 Drawing Figures

ELECTRICAL PLUG AND OUTLET UNIT

BACKGROUND OF THE INVENTION

1. Field of the Invention

This invention relates to an electrical plug and outlet unit adapted to be plugged into a high voltage receptacle for converting the high voltage from the receptacle into a lower voltage at least one outlet forming a part of the unit.

2. Description of the Prior Art

Many household air conditioners and other appliances require 220-volt current for effective operation, and some appliances require current of a higher voltage. On the other hand, most household appliances, such as lamps, radios, clocks and the like operate on a current of 110-volts. In many sections of the country where air conditioners are in general use, the employment of them usually is confined to the summer months, so that for the major portion of each year they are disconnected and placed in storage. Consequently, during such times, a high voltage wall receptacle employed to service an air conditioner serves no useful purpose whatsoever.

U.S. Pat. No. 3,349,363, issued to Goodman, discloses an electrical plug and outlet unit which is adapted for insertion into a conventional high voltage receptacle for providing a reduced voltage at each of two outlets associated with the unit. Accordingly, the Goodman unit can be employed as an intermediary to service low voltage appliances when high voltage devices, such as air conditioners, are not required to be serviced by a high voltage receptacle outlet.

The Goodman unit includes a pair of conductor prongs, each of which is adapted to be inserted into a respective hot socket of the high voltage receptacle. One of the conductor prongs is electrically connected to one of the contacts associated with one of the outlets of the unit, and the other conductor prong is electrically connected to one of the contacts associated with the other outlet of the unit. The Goodman unit also includes a ground prong which is adapted to be received within the grounded socket of the high voltage receptacle, and this ground prong is electrically connected to the other contact of both of the unit outlets. Accordingly, both of the hot lines of the high voltage receptacle are included in the circuitry of the Goodman unit, one of the hot lines being connected to a contact of one of the duplex outlets and the other hot line being connected to one of the contacts associated with the other duplex outlet.

If a child inadvertently bridges the hot contacts of the Goodman unit with an electrically conductive member and simultaneously touches a ground, the high voltage current of the receptacle will pass through the child. This high voltage current can cause serious injury, and even death.

The only fuses associated with the circuitry of the Goodman unit are the main fuses employed in the high voltage lines associated with the high voltage receptacle. Accordingly, these fuses generally have a lower resistance (i.e. higher amperage rating) than fuses commonly employed in lower voltage circuits of the type provided at the outlets of the Goodman unit. Therefore, a low voltage household appliance or device being served by the Goodman unit as an intermediary might cause a sudden surge of current which would normally blow a fuse that was properly rated for the lower voltage outlet; however, this surge might not blow the lower resistance fuse associated with the high voltage receptacle in time to prevent damage to the appliance or device. In any event, even if the surge of current were sufficiently great to blow the high voltage receptacle fuse, this fuse generally is located in a basement, or some other inconvenient location for replacement. If a lower amperage fuse were directly associated with the Goodman unit, that fuse, rather than the main fuse associated with the high voltage receptacle, would blow, and such a low amperage fuse would be easily accessable for quick replacement.

Electrical plug and outlet units having a fuse directly associated with them are known in the prior art, as evidenced by the disclosures in U.S. Pat. Nos. 2,508,770 (Oshinsky) and 2,454,024 (Alemaghides). These units are not designed for reducing the voltage associated with a wall receptacle. The units disclosed in the Oshinsky and Alemaghides patents are adapted to divide a single receptacle outlet into a plurality of outlets having the same voltage as the receptacle outlet.

SUMMARY OF THE INVENTION

The present invention resides in an electrical plug and outlet unit including at least one electrical outlet for providing a lower voltage current than a high voltage receptacle into which the unit is plugged. Specifically, the electrical plug and outlet unit is effective to provide a voltage equal to one-half the high voltage associated with the receptacle.

The electrical plug and outlet unit of this invention includes a non-conductive body member. A single conductor prong and single ground prong project rearwardly from within the body member and are arranged in a pattern such that the conductor prong is receivable within one of the hot sockets of a high voltage receptacle, and the ground prong is receivable within a grounded socket of said receptacle. At least one outlet, and preferably a pair of outlets, forms a part of the unit of this invention; each outlet including a pair of electrical contacts aligned with openings in a front face of the non-conductive body member for electrically engaging prongs of a conventional low voltage plug which are inserted into said openings. The unit of this invention includes first electrical conductive means for connecting the conductor prong to one contact of each outlet, and second electrical conductive means for connecting the ground prong to the other contact of each outlet. Accordingly, the circuitry associated with the electrical plug and outlet unit of this invention completely omits one of the hot lines of the high voltage receptacle. In this manner the voltage associated with each outlet of the electrical plug and outlet units is equal to one-half that of the high voltage receptacle.

By completely omitting one of the hot sockets of the high voltage receptacle from the circuitry of the electrical plug and outlet unit, a safer arrangement is provided than that which is disclosed in the Goodman pat. no. 3,349,363. Specifically, assuming that the high voltage receptacle is a conventional 220-volt receptacle, a child that inadvertently bridges adjacent hot contacts of a pair of outlets associated with the plug and outlet unit of this invention, and thereafter touches a ground, will only receive a 110-volt surge of current. Accordingly, the likelihood of injury or death to the child will be less than that resulting from the bridging of hot contacts of adjacent outlets in the Goodman unit.

In a preferred embodiment of this invention a single fuse is included in the first electrical conductive means between the conductor prong and the electrical contacts of each outlet. In this manner, a fuse having a proper rating for the lower voltage circuitry associated with the unit of this invention can be provided to prevent damage to a conventional low voltage appliance, or other device being serviced by said unit. Specifically, the fuse associated with the unit of this invention should have a lower amperage rating than the main fuses associated with the high voltage receptacle. Accordingly, an appliance-damaging surge of current which might not be sufficient to blow the main fuse of the high voltage receptacle will blow a properly rated fuse associated with the unit of this invention. Preferably, the fuse is retained in a simple and reliable manner within the first electrical conductive means to permit its easy removal and replacement in the event it is blown.

In the most preferred embodiment of this invention, each outlet of the unit is a three socket outlet for receiving a low voltage plug having an equipment ground prong associated with it. A conductive ground means is associated with the equipment ground sockets of the outlets for permitting the grounding of said sockets.

Other objects and advantages of this invention will become apparent upon reading the detailed description which follows, taken in conjunction with the drawings.

DESCRIPTION OF THE PREFERRED EMBODIMENT OF THE INVENTION

Figure 1:
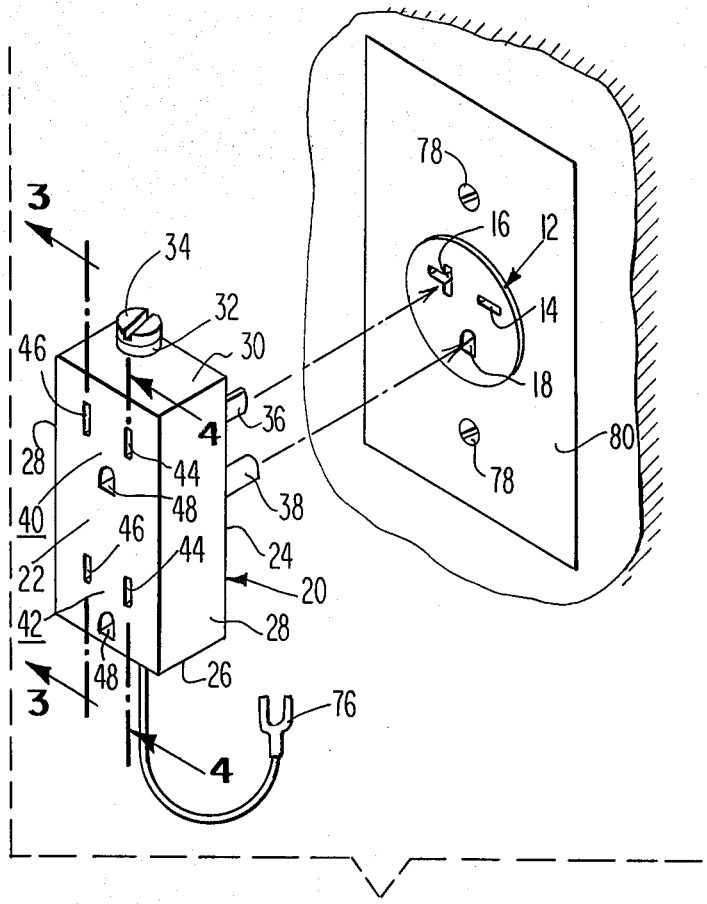
FIG. 1 is an exploded isometric view of an electrical plug and outlet unit according to this invention, and adapted to be plugged into a high voltage wall receptacle.

Referring to FIG. 1, an electrical plug and outlet unit 10 according to this invention is adapted to be plugged into a conventional three-hole, high voltage wall receptacle 12. As shown in FIG. 1, the holes 14 and 16 in the wall receptacle 12 are in alignment with electrical contacts connected to hot lines of the high voltage circuitry. The hole 18 is aligned with a contact that is grounded, and this last referred to hole constitutes the equipment ground for an appliance, or other device requiring a high voltage current for its operation.

Referring again to FIG. 1, the electrical plug and outlet unit 10 includes a non-conductive body member 20 having a front wall 22, a rear wall 24, a bottom wall 26, opposed side walls 28, a top wall 30 and a fuse housing 32. The non-conductive body member 20 can be molded as a single unit with electrically conductive elements disposed therein, or alternatively, the body member 20 can be formed as a split-housing to permit the separate insertion of the conductive elements into the interior of the body prior to completing the assembly of said body member. In the embodiment shown for illustration, the non-conductive body member 20 is of a unitarily molded construction, and a separate screw cap 34 closes the open end of the fuse housing 32.

Figure 2:
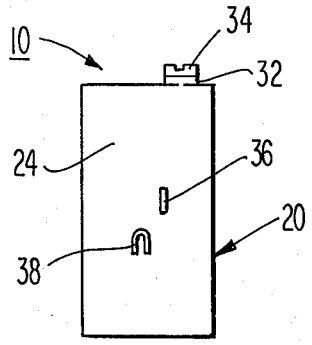
FIG. 2 is a rear elevation view of the electrical plug and outlet unit shown in FIG. 1.

Referring to FIGS. 1 and 2, a single conductor prong 36 and a single ground prong 38 project rearwardly from within the body member 20. These prongs are arranged in a pattern for permitting the conductor prong to be received within the hole 16 of the high voltage wall receptacle 12 for providing a hot connection, and for permitting the ground prong 38 to be received within the hole 18 of said wall receptacle for providing a ground connection.

Figure 3:
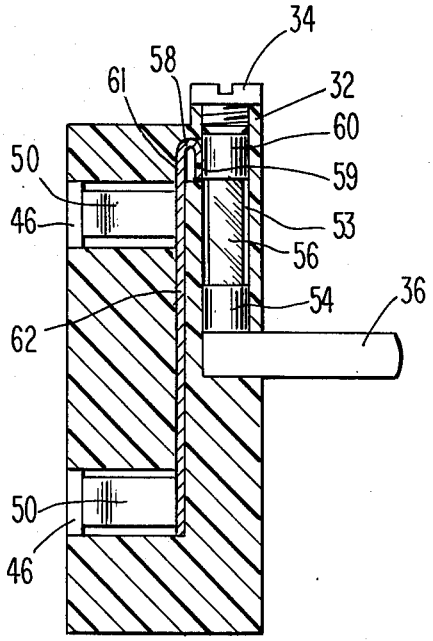
FIG. 3 is a cross-sectional view taken along line 3—3 of FIG. 1.

Referring to FIGS. 1 and 3, a pair of outlets 40 and 42 are included in the front wall 22 of the unit 10. Each of the outlets 40 and 42 includes three openings 44, 46 and 48 therein. The openings 44 and 46 are aligned with electrical contacts for servicing a low voltage appliance, or other low voltage device, when prongs of a low voltage plug associated with said appliance or device are inserted therein. The opening 48 is aligned with a contact which constitutes an equipment ground, and accordingly, this opening 48 is adapted to receive an equipment ground prong of the low voltage plug. Opening 46 of each outlet 40 and 42 is aligned with an electrical contact 50 that is electrically connected to a hot line of the high voltage receptacle 12 when the conductor prong 36 of the unit 10 is plugged into opening 16 of said high voltage receptacle. Specifically, the conductor prong 36 is in engagement with a bottom conductive cap 54 of a cartridge fuse 56 when the cartridge fuse is disposed in an interior compartment 53 of the fuse housing 32. The screw cap 34 retains the fuse 56 in engagement with the conductor prong 32. A conductive spring clip 58 includes a leg 59 which is biased toward the interior of compartment 53 for engaging an upper conductive cap 60 of the cartridge fuse 56. This spring clip 58 includes a second leg 61 in electrical engagement with a conductive bus bar 62 which in turn is unitarily formed with the electrical contacts 50.

Figure 5:
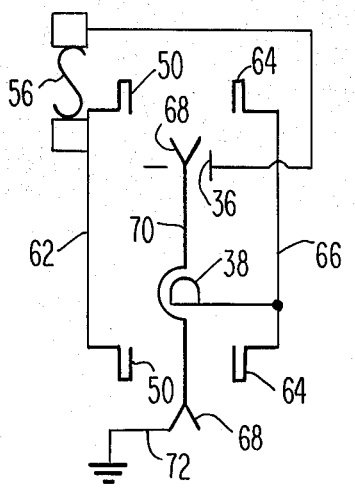
FIG. 5 is a schematic diagram showing the circuitry of the electrical plug and outlet unit of this invention.

Referring to FIG. 5, it can easily be seen that the cartridge fuse 56 is in series with the conductor prong 36 and the electrical contacts 50 that are unitarily formed with the bus 62.

Figure 4:
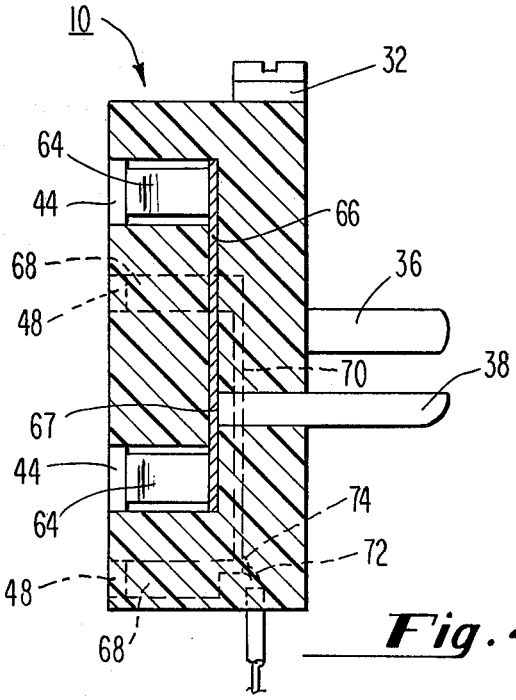
FIG. 4 is a cross-sectional view taken along line 4—4 of FIG. 1.

Referring to FIG. 4, the opening 44 of each of the outlets 40 and 42 is aligned with an electrical contact 64 which is the neutral, or ground contact, when the unit 10 is plugged into the high voltage wall receptacle 12. Specifically, the contacts 64 are unitarily formed with a conductive bus 66, and the ground prong 38 is electrically connected to this bus at 67. Accordingly, when the ground prong 38 is inserted into the equipment ground hole 18 of the wall receptacle 12, the ground connection to contacts 64 is completed. Thus, the electrical contacts 50 and 64 of each of the outlets 40 and 42, respectively, are adapted to service a low voltage appliance or device when prongs of a low voltage plug associated with said appliance or device are inserted into the openings 44 and 46 of one of the outlets 40 and 42, respectively.

Referring to FIG. 5, the circuitry between the ground prong 38, bus 66, and the contact 64 is represented schematically.

Referring again to FIGS. 1 and 4, in the preferred embodiment of this invention, each of the outlets 40 and 42 includes an equipment ground opening 48 associated with it. The equipment ground openings 48 are each aligned with an electrical contact 68 that is unitarily formed with an electrically conductive bus 70. One end of an electrically conductive ground wire 72 is electrically connected to the bus 70 by a solder joint 74. The opposite end of the ground wire 72 includes a U-shaped conductive clip 76. The conductive clip 76 can be engaged by one of the screws 78 which secures a face plate 80 in proper relationship to the high voltage receptacle 12. This screw 78 is electrically grounded in a well known manner, and accordingly, the connection of the U-shaped clip 76 to said screw grounds the contacts 68.

Referring to FIG. 5, the circuit connections between the ground wire 72, electrical contacts 68 and the bus 70 is schematically represented.

From the above discussion it is apparent that when the electrical plug and outlet unit 10 of this invention is inserted into the high voltage receptacle 12 one of the hot lines associated with the receptacle 12 is completely omitted from the circuitry of the unit 10. Accordingly, the voltage supplied at each of the outlets 40 and 42 of the unit 10 of this invention is one-half that of the voltage output of the receptacle 12. Moreover, the preferred construction of the electrical plug and outlet unit 10 according to this invention permits the inclusion of a fuse therein which can be properly rated for the particular appliance or device being serviced. In this manner, should the circuit become overloaded by a sudden surge of current, the fuse associated with the unit 10 of this invention will blow prior to the main fuse, and since this fuse is directly at the wall outlet, it can be conveniently replaced.

Having described my invention, I claim:

1. An electrical plug and outlet unit adapted to be plugged into a high voltage, three-hole receptacle in which two of the holes are aligned with electrical contacts connected to hot lines for providing the high voltage current, and the other of said receptacle holes is aligned with a grounded electrical contact to provide an equipment ground; said unit comprising:

A. a non-conductive body member;

B. a single conductor prong and a single ground prong projecting rearwardly of the body member, said prongs being arranged in a pattern for permitting the conductor prong to be received within a receptacle hole aligned with an electrical contact connected to one of the high voltage hot lines, and for permitting the ground prong to be received within the receptacle hole aligned with the grounded electrical contact;

C. at least one outlet, each outlet including a pair of electrical contacts aligned with openings in a front face of said body member for permitting prongs of a conventional low voltage plug to be inserted through said openings into engagement with the electrical contacts aligned with said openings;

D. first electrical conductive means for connecting the conductor prong to one of said pair of electrical contacts of each outlet; and E. second electrical conductive means for connecting the ground prong to the other of said pair of electrical contacts of each outlet, whereby one of the hot lines associated with the high voltage receptacle is excluded from the circuitry associated with each outlet of the plug and outlet unit.

2. The unit according to claim 1, including at least a pair of outlets.

3. The unit according to claim 2, wherein said first electrical conductive means includes a fuse therein.

4. The unit according to claim 3, wherein said fuse is a cartridge fuse.

5. The unit according to claim 1, wherein each outlet includes a third electrical contact aligned with a third opening in the front face of said body member, the third opening of each outlet being adapted to receive an equipment ground prong of a conventional low voltage plug, and conductive ground means associated with the third contact of each outlet for permitting the grounding of said third contact.

6. The unit according to claim 2, wherein each outlet includes a third electrical contact aligned with a third opening in the front face of said body member, the third opening of each outlet being adapted to receive an equipment ground prong of a conventional low voltage plug, and conductive ground means associated with the third contact of each outlet for permitting the grounding of said third contact.

7. The unit according to claim 3, wherein each outlet includes a third electrical contact aligned with a third opening in the front face of said body member, the third opening of each outlet being adapted to receive an equipment ground prong of a conventional low voltage plug, and conductive ground means associated with the third contact of each outlet for permitting the grounding of said third contact.

8. The unit according to claim 4, wherein each outlet includes a third electrical contact aligned with a third opening in the front face of said body member, the third opening of each outlet being adapted to receive an equipment ground prong of a conventional low voltage plug, and conductive ground means associated with the third contact of each outlet for permitting the grounding of said third contact.

* * * * *